US011654330B2

(12) United States Patent
Abbott

(10) Patent No.: US 11,654,330 B2
(45) Date of Patent: May 23, 2023

(54) DOORWAY PULLUP HANDLE

(71) Applicant: Jayflex Fitness, Orem, UT (US)

(72) Inventor: Ethan Abbott, Orem, UT (US)

( * ) Notice: Subject to any disclaimer, the term of this patent is extended or adjusted under 35 U.S.C. 154(b) by 98 days.

(21) Appl. No.: 17/179,257

(22) Filed: Feb. 18, 2021

(65) Prior Publication Data

US 2021/0260439 A1 Aug. 26, 2021

Related U.S. Application Data

(60) Provisional application No. 62/980,067, filed on Feb. 21, 2020.

(51) Int. Cl.
*A63B 23/12* (2006.01)
*A63B 21/00* (2006.01)

(52) U.S. Cl.
CPC ..... *A63B 23/1218* (2013.01); *A63B 21/4035* (2015.10); *A63B 21/4047* (2015.10)

(58) Field of Classification Search
CPC ... A63B 7/00; A63B 21/00185; A63B 21/068; A63B 21/1618; A63B 21/1636; A63B 21/4027; A63B 21/4033; A63B 21/4035; A63B 21/4047; A63B 21/4049; A63B 23/12; A63B 23/1209; A63B 23/1218; A63B 71/0036; A63B 71/0054; A63B 2208/0285; A63B 2208/029; A63B 2210/00; A63B 2210/50; A63B 2225/09; A63B 2225/093
See application file for complete search history.

(56) References Cited

U.S. PATENT DOCUMENTS

| | | | | |
|---|---|---|---|---|
| 3,526,399 | A * | 9/1970 | Hjelte | A63B 22/0005 482/40 |
| 3,716,232 | A * | 2/1973 | Johnson | A63B 1/005 482/40 |
| 5,776,033 | A * | 7/1998 | Brown | A63B 21/1636 482/40 |
| 6,503,175 | B1 * | 1/2003 | Harrell | A63B 21/1636 482/40 |
| 6,705,974 | B1 * | 3/2004 | Tardif | A63B 21/1636 482/40 |
| D518,534 | S * | 4/2006 | Giordano | D21/662 |
| 7,601,100 | B1 * | 10/2009 | Hinds | A63B 23/12 482/40 |
| 10,695,609 | B2 * | 6/2020 | Anastasi | A63B 21/068 |
| 10,744,369 | B2 * | 8/2020 | Abbott | A63B 21/1627 |
| D937,371 | S * | 11/2021 | Abbott | A63B 22/0005 D21/694 |
| 2009/0017996 | A1 * | 1/2009 | Chic | A63B 21/0552 482/92 |

(Continued)

FOREIGN PATENT DOCUMENTS

| | | | | |
|---|---|---|---|---|
| KR | 20150000535 U | * | 2/2015 | A63B 23/12 |

*Primary Examiner* — Gary D Urbiel Goldner
(74) *Attorney, Agent, or Firm* — Superior IP, PLLC; Dustin L Call

(57) ABSTRACT

A pullup handle includes a U-shaped clamp configured to secure the pullup handle to a desired location. The U-shaped clamp includes an arm on a first side of the U-shaped clamp, a support on a second side of the U-shaped clamp opposite the arm, and a base between the arm and the support. The pullup handle also includes a handle attached on the base of the U-shaped clamp.

18 Claims, 17 Drawing Sheets

(56) References Cited

U.S. PATENT DOCUMENTS

| | | | | |
|---|---|---|---|---|
| 2009/0111661 | A1* | 4/2009 | Hauser | A63B 23/1209 482/40 |
| 2009/0203508 | A1* | 8/2009 | Hauser | A63B 1/00 482/139 |
| 2010/0144502 | A1* | 6/2010 | Hinds | A63B 21/4035 482/141 |
| 2012/0302410 | A1* | 11/2012 | Kitchens | A63B 23/1236 482/96 |
| 2013/0012360 | A1* | 1/2013 | Stone | A63B 21/4043 482/23 |
| 2013/0165298 | A1* | 6/2013 | Demsey | A63B 23/0205 482/40 |
| 2015/0105186 | A1* | 4/2015 | Block | A63B 71/04 473/416 |
| 2016/0256720 | A1* | 9/2016 | Grant | A63B 21/4035 |
| 2016/0303419 | A1* | 10/2016 | Karpachevskyy | A63B 21/4035 |
| 2019/0314671 | A1* | 10/2019 | Abbott | F16B 2/12 |
| 2020/0398105 | A1* | 12/2020 | Coulter | A63B 23/1218 |

* cited by examiner

DOORWAY PULLUP HANDLE

CROSS-REFERENCE TO RELATED APPLICATIONS

This application claims the benefit of and priority to U.S. Provisional Patent Application Ser. No. 62/980,067 filed on Feb. 21, 2020, which application is incorporated herein by reference in its entirety.

BACKGROUND OF THE INVENTION

Pullup bars that attach to doorframes, and other exercise handles in general, are not compact. In particular, since pullup bars are a long horizontal bar, they take up space across the width of the door. In addition, they are often left on doorways, which prevents the door from closing. Thus, rather than placing the pullup bar in a location that will be convenient or encourage exercise, they are placed where they will cause the least inconvenience.

In addition, pullup bars don't lock onto the attachment location. That is, they are essentially balanced on the top of a door frame. While they purport to use the user's weight to stabilize the bar position, if the user shifts his/her weight then the stability of the bar can be dramatically affected resulting in a fall and/or injury. Installation of brackets or other attachment means increases stability but removes all ability to move the bar, eliminating one of the key benefits of an at home pullup bar.

Further, pullup bars can cause permanent damage. For example, many pullup bars have a support bar which is pressed against a door frame to prevent the pullup bar from falling. This pressure can cause damage to the door frame. In addition, the weight is all supported by a small portion of a door's upper molding. Over time, this can move or otherwise damage the molding.

Finally, pullup bars do not travel well. Their bulkiness means that they are not able to be placed in luggage. Therefore, any travel requires at least partial disassembly of the pullup bar. This is an inconvenience that means many users will simply refuse to take the pullup bar, missing out on the benefits of this exercise.

Accordingly, there is a need in the art for a pullup system which is compact, stable, doesn't cause damage and travels well.

BRIEF SUMMARY OF SOME EXAMPLE EMBODIMENTS

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

One example embodiment includes a pullup handle. The pullup handle includes a U-shaped clamp. The U-shaped clamp is configured to secure the pullup handle to a desired location. The U-shaped clamp includes an arm on a first side of the U-shaped clamp, a support on a second side of the U-shaped clamp opposite the arm, and a base between the arm and the support. The pullup handle also includes a handle attached on the base of the U-shaped clamp.

Another example embodiment includes a pullup handle. The pullup handle includes a U-shaped clamp, the U-shaped clamp configured to secure the pullup handle to a desired location. The U-shaped clamp includes a pair of arms on a first side of the U-shaped clamp and a support on a second side of the U-shaped clamp opposite the arm. The U-shaped clamp also includes a base between the arm and the support, where the base includes a set of parallel rails. The U-shaped clamp further includes a first set of hinges, where the first set of hinges attaches the pair of arms to the set of parallel rails and a second set of hinges, where the second set of hinges attaches the support to the set of parallel rails. The width of the support is smaller than a gap between the pair of arms. The pullup handle also includes a handle attached on the base of the U-shaped clamp and a grip, where the grip covers at least a portion of the handle.

Another example embodiment includes a pullup handle. The pullup handle includes a U-shaped clamp, the U-shaped clamp configured to secure the pullup handle to a desired location. The U-shaped clamp includes a pair of arms on a first side of the U-shaped clamp and a support on a second side of the U-shaped clamp opposite the arm, where the support includes a brace. The U-shaped clamp also includes a base between the arm and the support, where the base includes a set of parallel rails. The U-shaped clamp further includes a first set of hinges, where the first set of hinges attaches the pair of arms to the set of parallel rails and a second set of hinges, where the second set of hinges attaches the brace to the set of parallel rails. This U-shaped clamp additionally includes a first cross-bar attached to the pair of arms opposite the first set of hinges, a second cross-bar attached to the pair of arms, a third cross-bar attached to the support opposite the second set of hinges, and a fourth cross-bar attached to the support. The width of the support is smaller than a gap between the pair of arms. The pullup handle also includes a handle attached on the base of the U-shaped clamp and a grip, where the grip covers at least a portion of the handle.

These and other objects and features of the present invention will become more fully apparent from the following description and appended claims, or may be learned by the practice of the invention as set forth hereinafter.

BRIEF DESCRIPTION OF THE DRAWINGS

To further clarify various aspects of some example embodiments of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION OF SOME EXAMPLE EMBODIMENTS

Reference will now be made to the figures wherein like structures will be provided with like reference designations. It is understood that the figures are diagrammatic and schematic representations of some embodiments of the invention, and are not limiting of the present invention, nor are they necessarily drawn to scale.

Figure 1A:
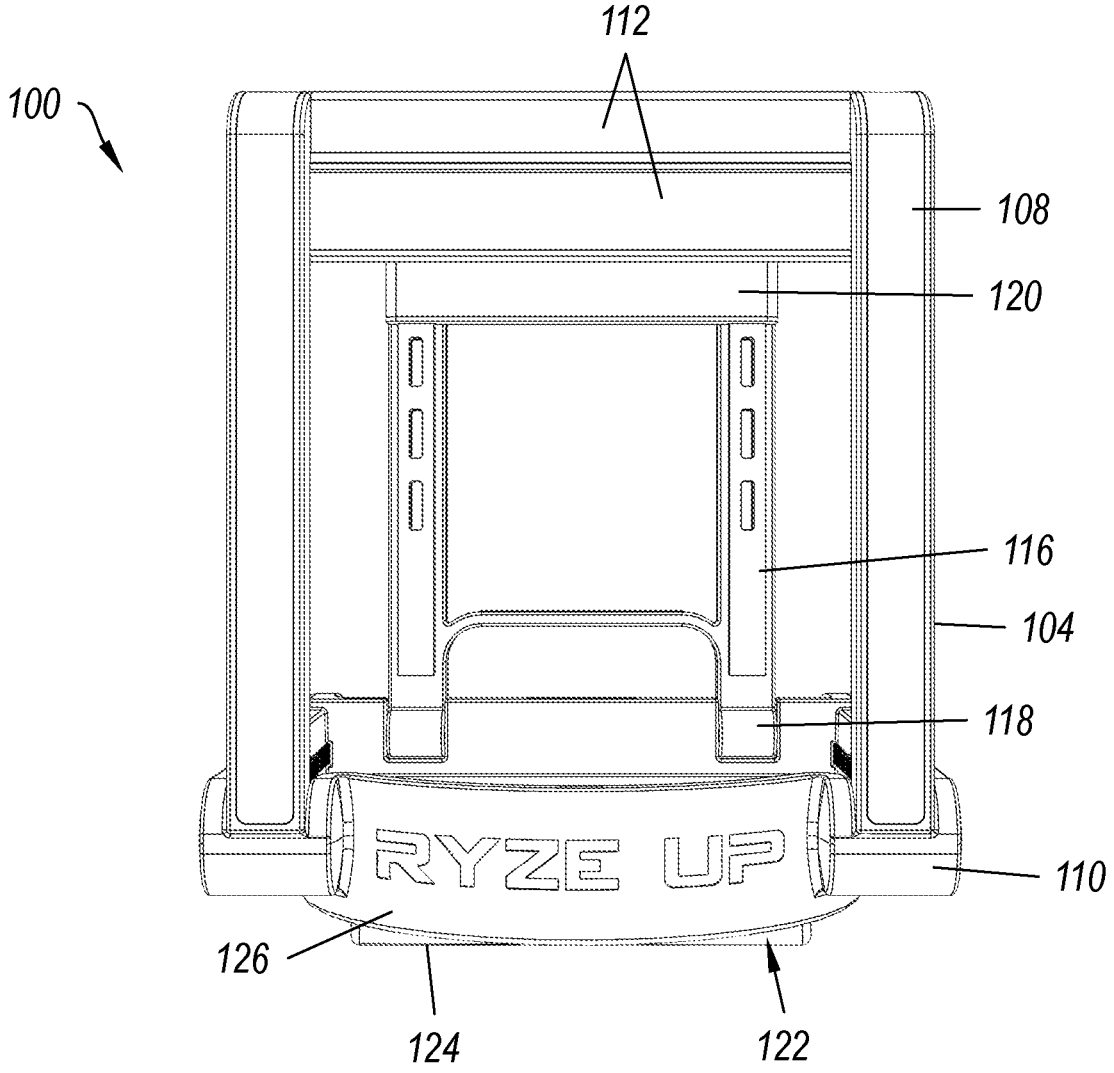
FIG. 1A illustrates a front view of the example of a doorway pullup handle.
Figure 1B:
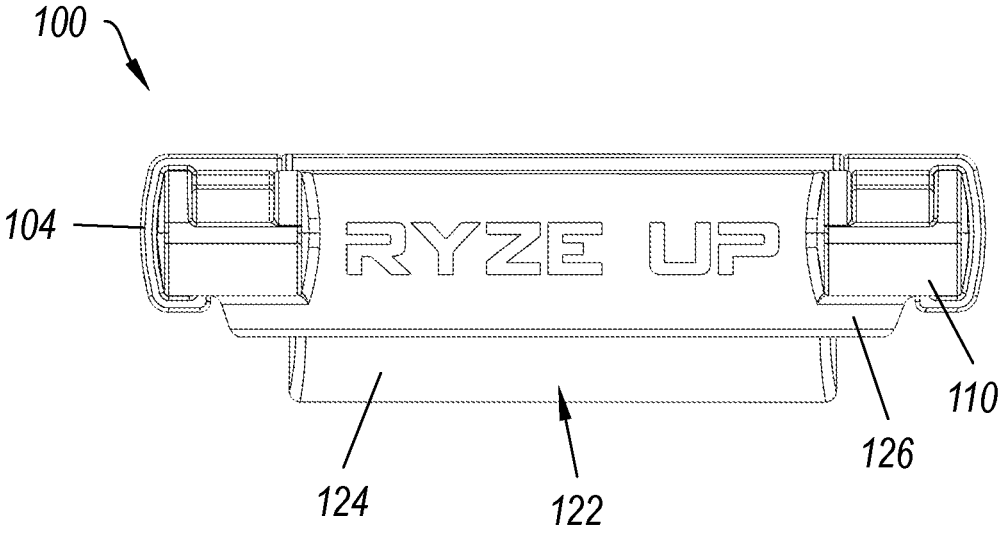
FIG. 1B illustrates a front view of the example of a doorway pullup handle in a folded position.
Figure 1C:
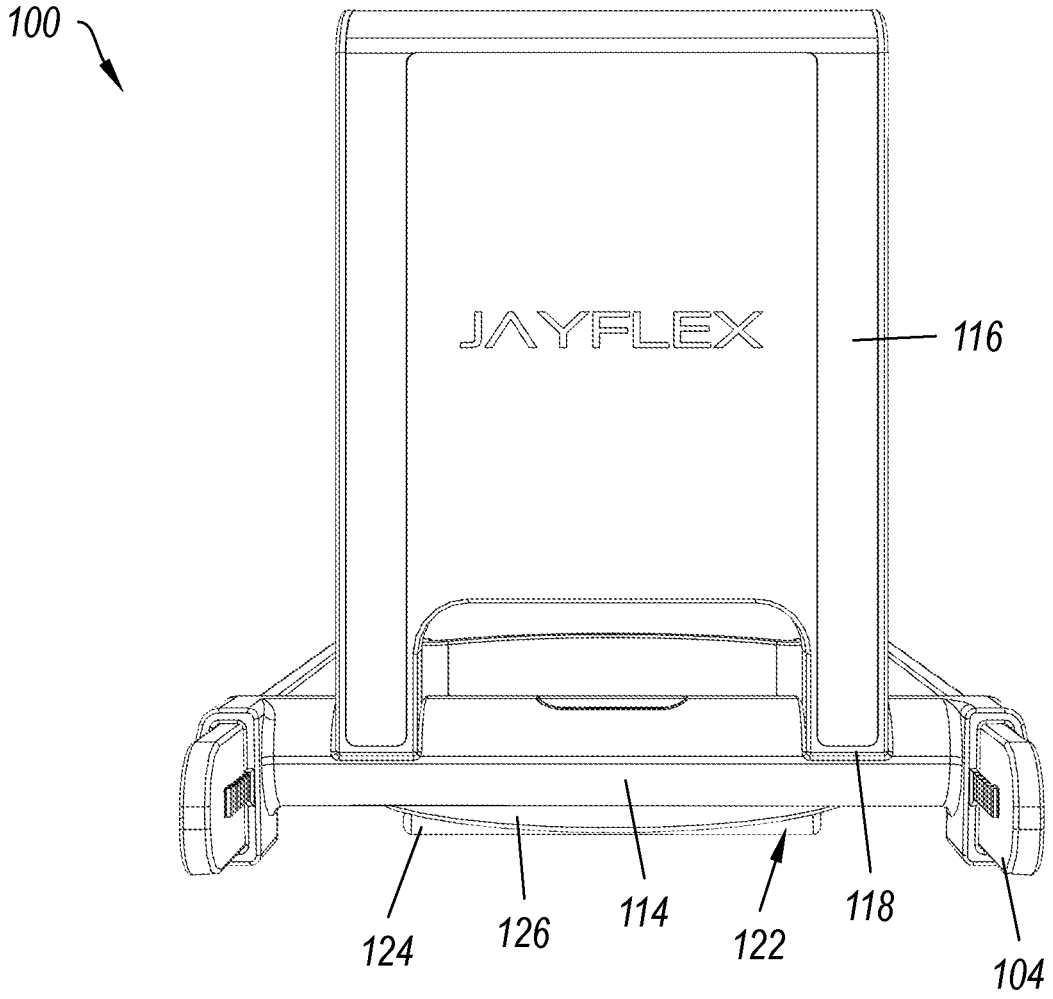
FIG. 1C illustrates a rear view of the example of a doorway pullup handle.
Figure 1D:
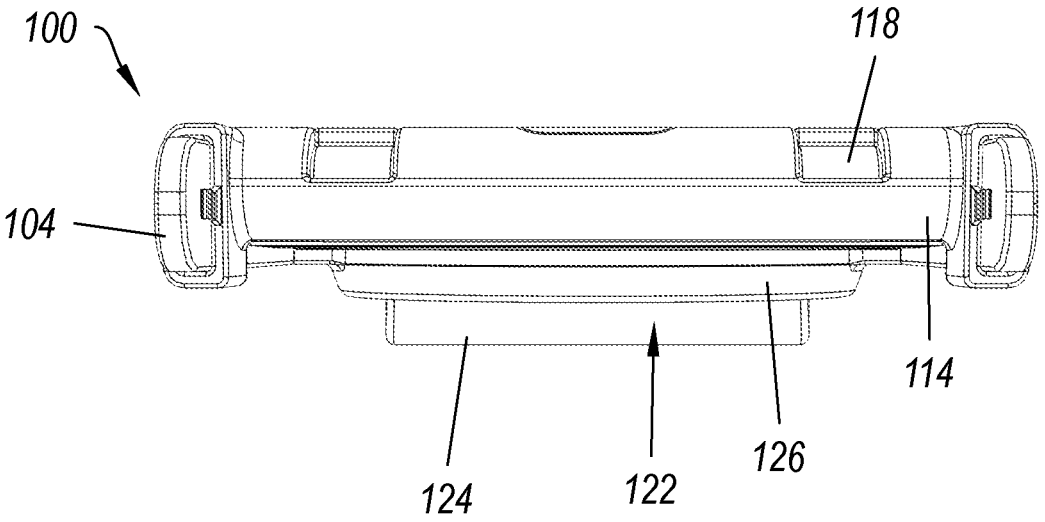
FIG. 1D illustrates a rear view of the example of a doorway pullup handle in a folded position.
Figure 1E:
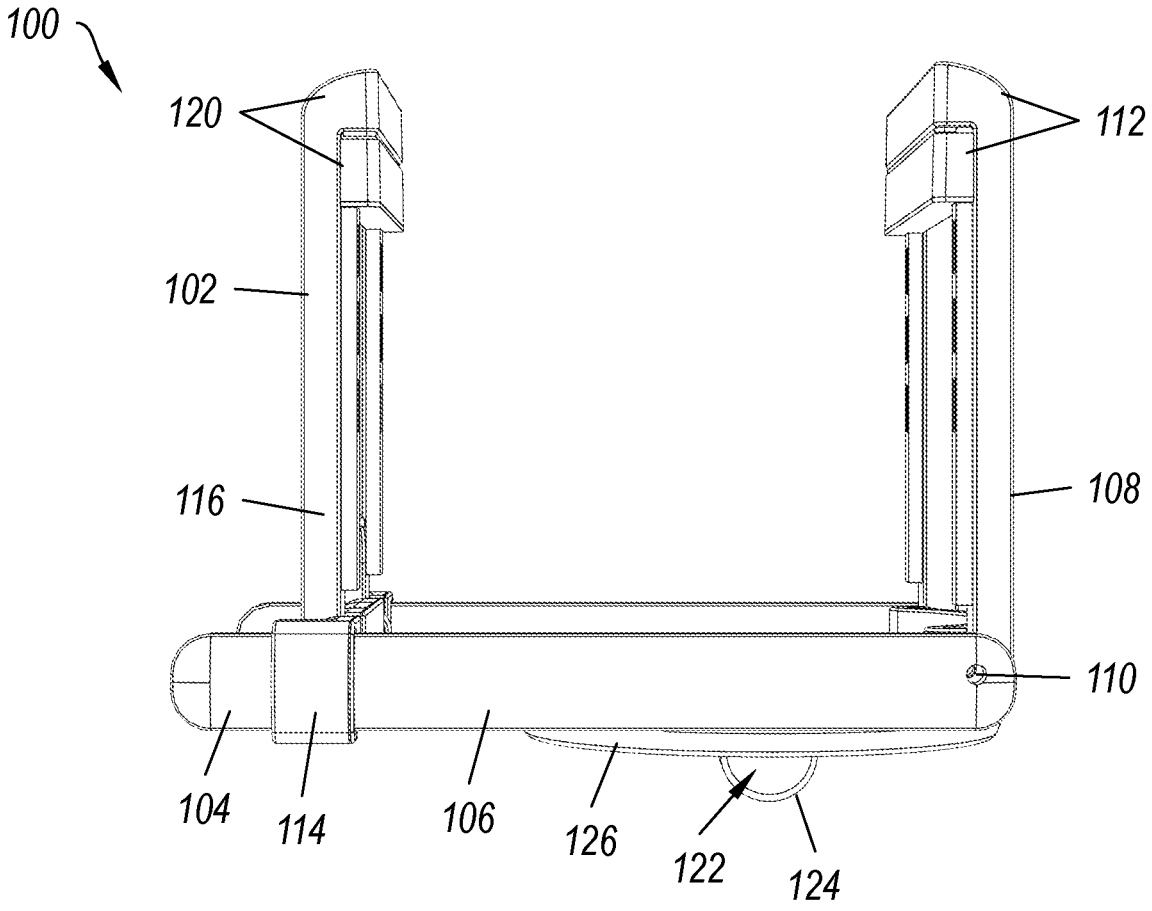
FIG. 1E illustrates a side view of the example of a doorway pullup handle.
Figure 1F:
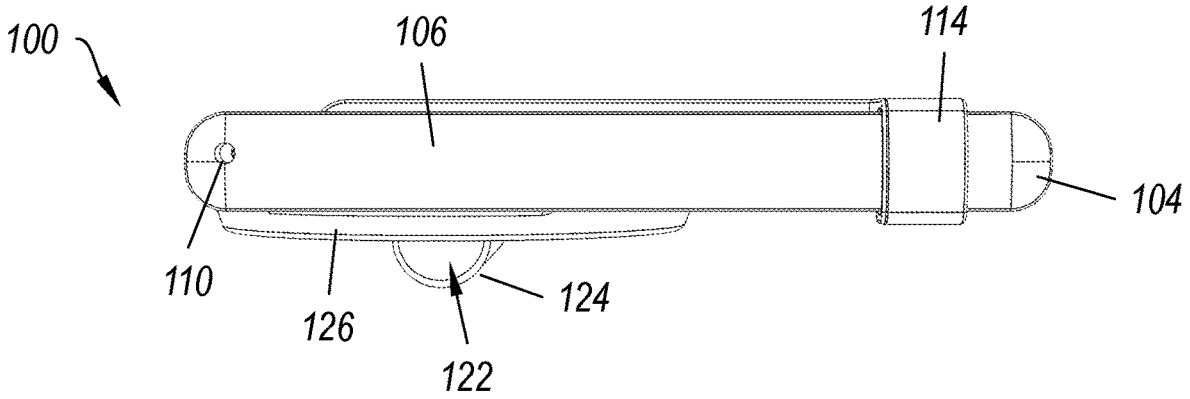
FIG. 1F illustrates a side view of the example of a doorway pullup handle in a folded position.
Figure 1G:
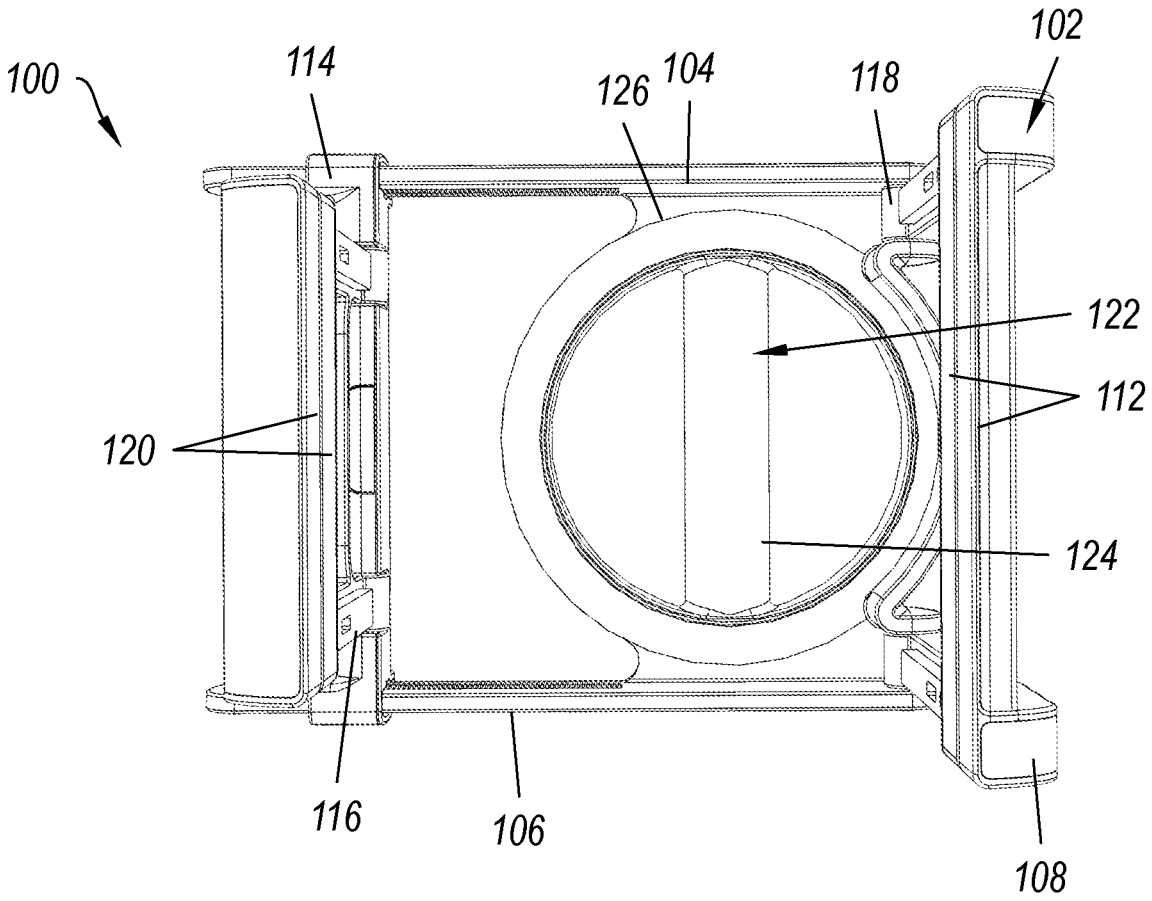
FIG. 1G illustrates a top view of the example of a doorway pullup handle.
Figure 1H:
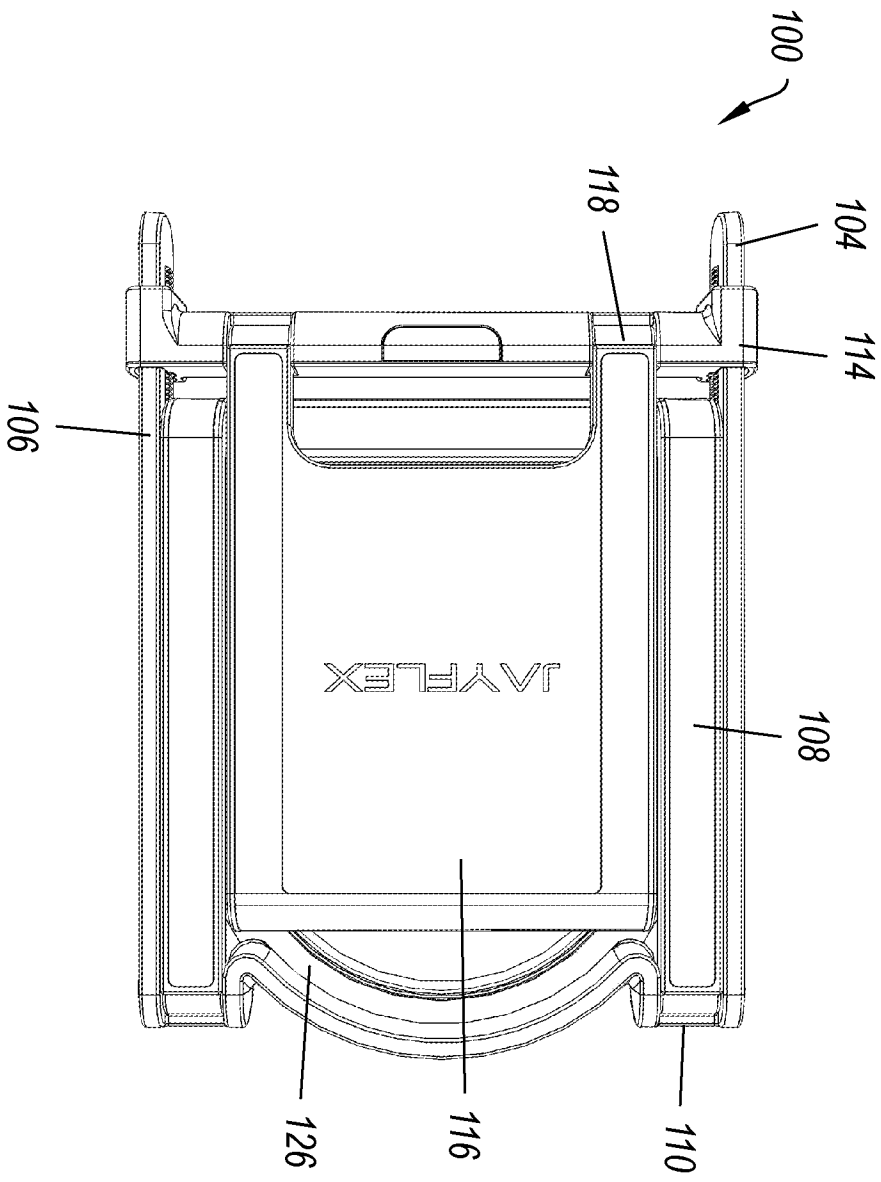
FIG. 1H illustrates a top view of the example of a doorway pullup handle in a folded position.
Figure 1I:
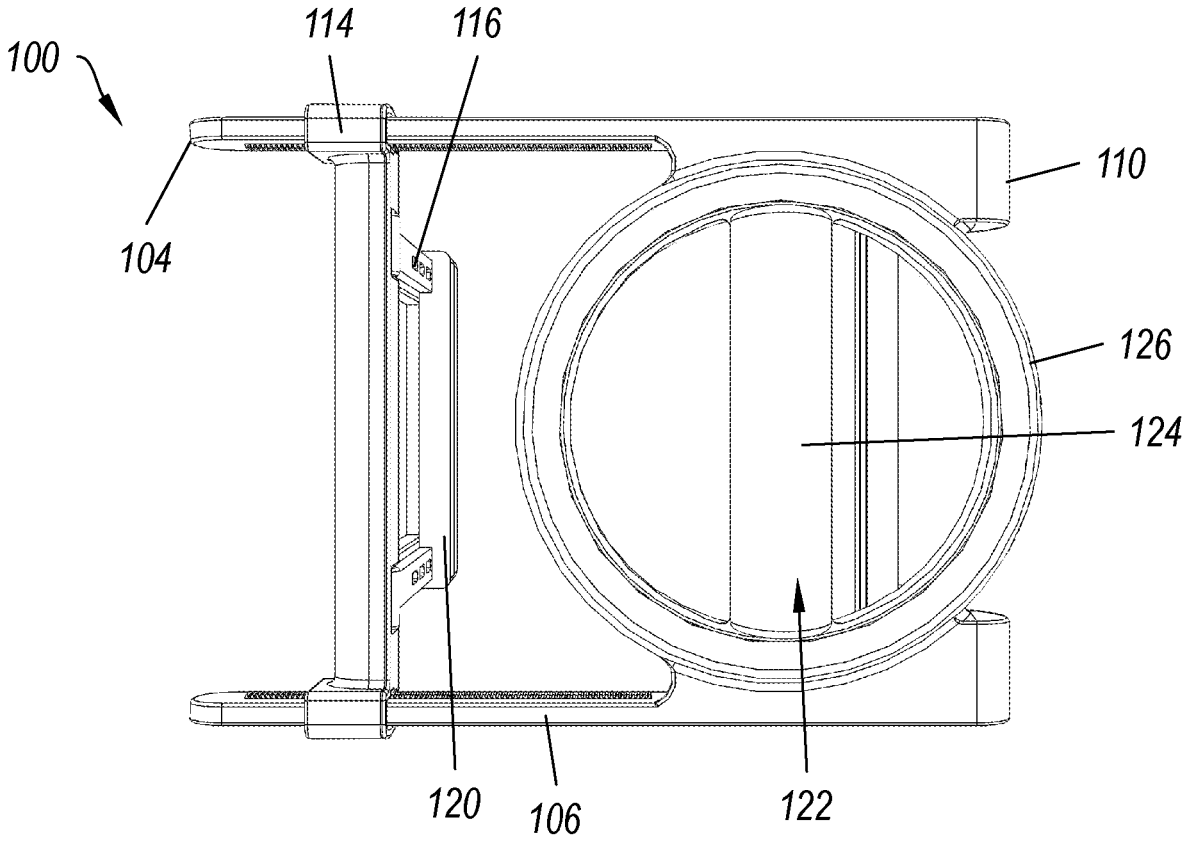
FIG. 1I illustrates a bottom view of the example of a doorway pullup handle.
Figure 1J:
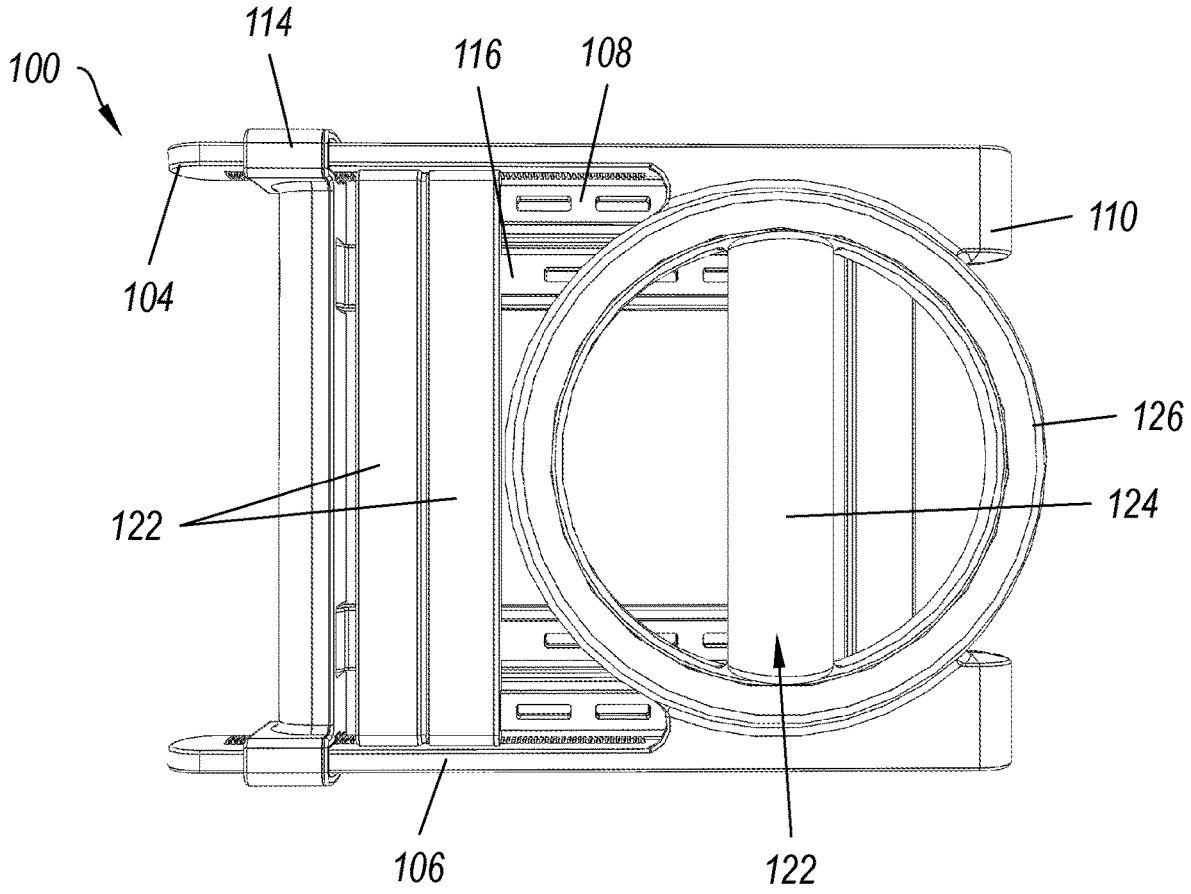
FIG. 1J illustrates a bottom view of the example of a doorway pullup handle in a folded position.
Figure 1K:
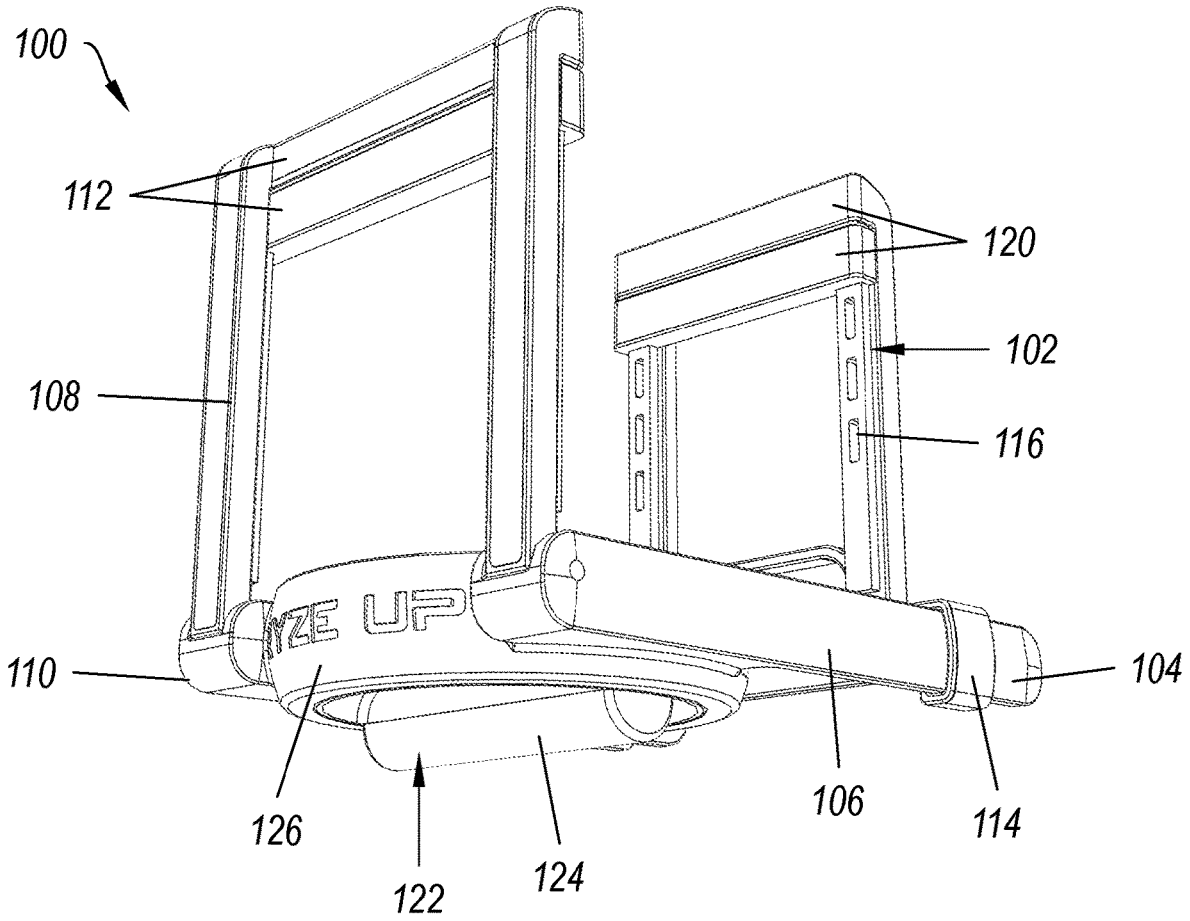
FIG. 1K illustrates a front side bottom isometric view of the example of a doorway pullup handle.
Figure 1L:
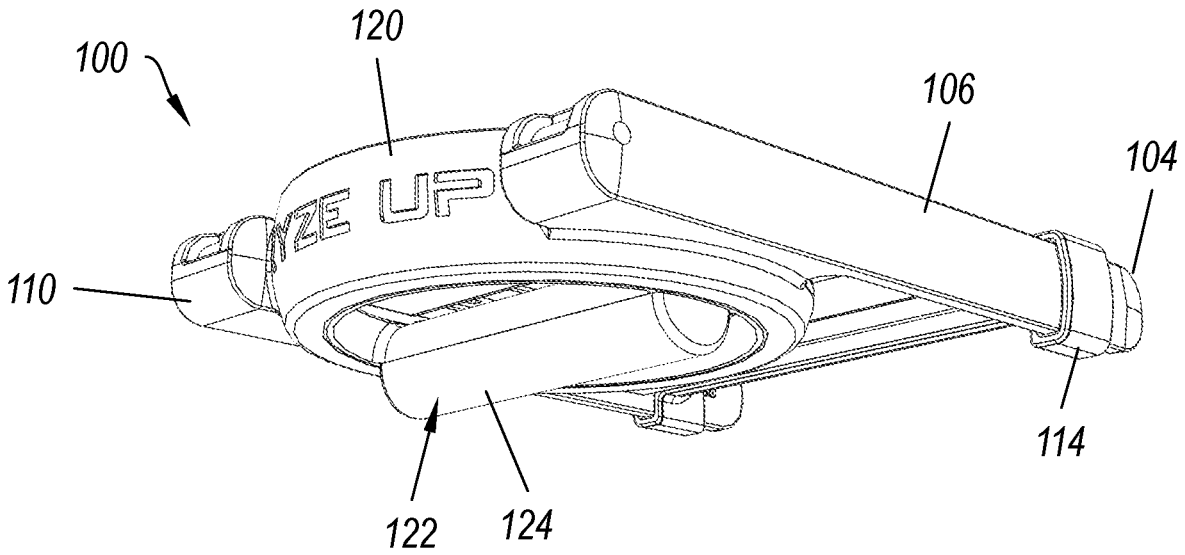
FIG. 1L illustrates a front side bottom isometric view of the example of a doorway pullup handle in a folded position.
Figure 1M:
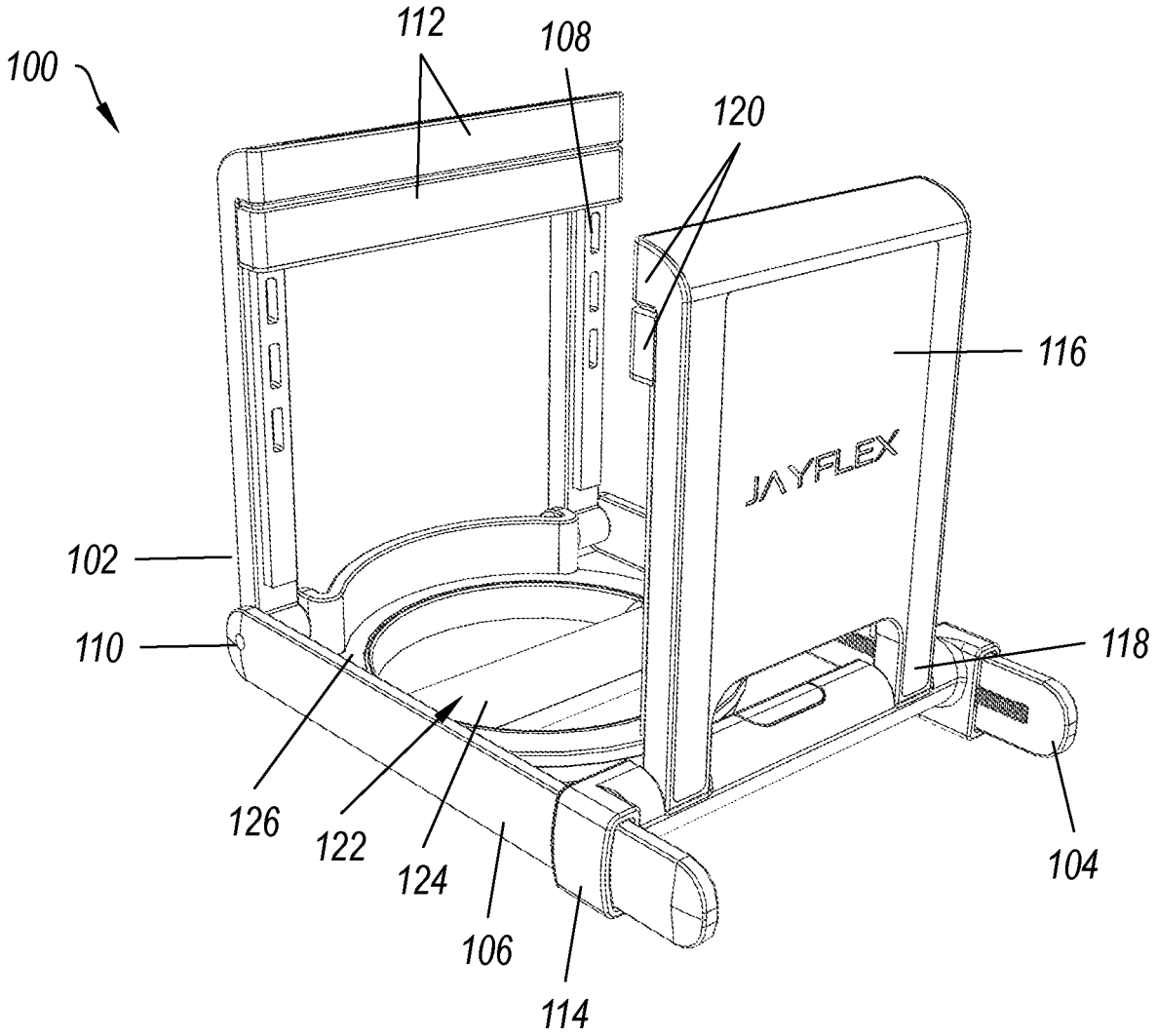
FIG. 1M illustrates a rear top side isometric view of the example of a doorway pullup handle.
Figure 1N:
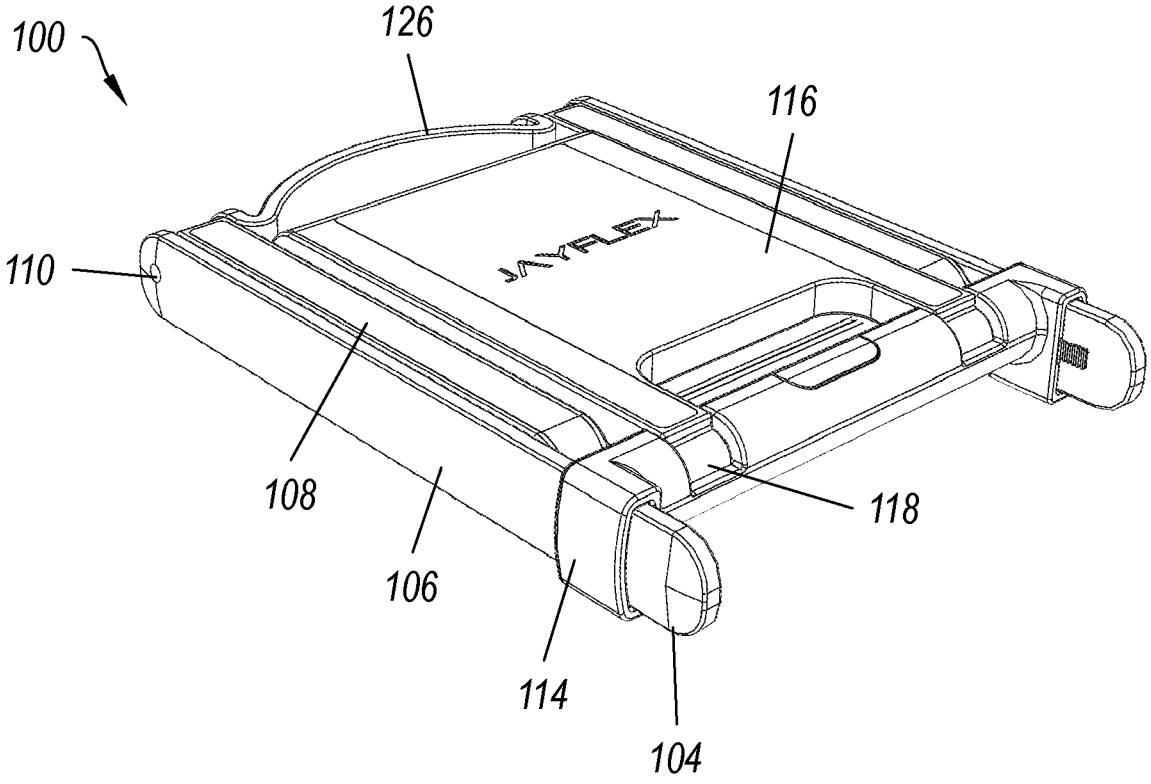
FIG. 1N illustrates a rear top side isometric view of the example of a doorway pullup handle in a folded position.

FIGS. 1A-1N (collectively "FIG. 1") illustrate an example of a doorway pullup handle 100. FIG. 1A illustrates a front view of the example of a doorway pullup handle 100; FIG. 1B illustrates a front view of the example of a doorway pullup handle 100 in a folded position; FIG. 1C illustrates a rear view of the example of a doorway pullup handle 100; FIG. 1D illustrates a rear view of the example of a doorway pullup handle 100 in a folded position; FIG. 1E illustrates a side view of the example of a doorway pullup handle 100; FIG. 1F illustrates a side view of the example of a doorway pullup handle 100 in a folded position; FIG. 1G illustrates a top view of the example of a doorway pullup handle 100; FIG. 1H illustrates a top view of the example of a doorway pullup handle 100 in a folded position; FIG. 1I illustrates a bottom view of the example of a doorway pullup handle 100; FIG. 1J illustrates a bottom view of the example of a doorway pullup handle 100 in a folded position; FIG. 1K illustrates a front side bottom isometric view of the example of a doorway pullup handle 100; FIG. 1L illustrates a front side bottom isometric view of the example of a doorway pullup handle 100 in a folded position; FIG. 1M illustrates a rear top side isometric view of the example of a doorway pullup handle 100; and FIG. 1N illustrates a rear top side isometric view of the example of a doorway pullup handle 100 in a folded position.

FIG. 1 shows that the doorway pullup handle 100 can include a U-Shaped clamp 102. The U-shaped clamp 102 is configured to secure the pullup handle 100 to a desired location. For example, the U-shaped clamp 102 can be used to secure the pullup handle 100 to the top of a door frame or similar location. The U-shaped clamp 102 must be able to secure the pullup handle 100 securely enough that not only is the pullup handle 100 supported, but so is the weight of a user hanging from the pullup handle 100, as described below. As used in the specification and the claims, the phrase "configured to" denotes an actual state of configuration that fundamentally ties recited elements to the physical characteristics of the recited structure. That is, the phrase "configured to" denotes that the element is structurally capable of performing the cited element but need not necessarily be doing so at any given time. Thus, the phrase "configured to" reaches well beyond merely describing functional language or intended use since the phrase actively recites an actual state of configuration.

As used herein, a "clamp" is a fastening device used to create inward pressure. Thus, the U-shaped clamp 102 provides an inward pressure on a surface. The inward pressure ensures that all downward pressure (i.e., weight) is then transferred to an adjacent surface. For example, if the U-shaped clamp 102 is secured to a door frame, then the U-shaped clamp provides an inward pressure on the wall above the doorframe. Thus, any weight then rests on the top of the doorframe. I.e., the U-shaped clamp 102 ensures through inward pressure that all the weight of both the pullup handle and the user is transferred to the doorframe or other securing area.

FIG. 1 also shows that the U-shaped clamp 102 can include a base 104. The base 104 allows the inner spacing of the U-shaped clamp 102 to be adjusted by the user. In particular, the base 104 allows the user to create more spacing within the U-shaped clamp 102 in order to place the pullup handle 100 then reduce the amount of spacing with the U-shaped clamp 102 to secure the pullup handle 100 in place. The revers is true when removing the pullup handle 100.

FIG. 1 further shows that the base 104 can include two rails 106. The rails 106 allow the inner spacing of the U-shaped clamp 102 to be adjusted. The rails 106 are generally parallel to one another. This is because as the inner spacing of the U-shaped clamp is changed, non-parallel rails 106 would lead to twisting or an inability to make adjustments. The rails 106 include one or more features that allow the user to change the inner spacing of the U-shaped clamp 102, as discussed below. The rails 106 can telescope in order to create a U-shaped clamp 102 which allows for a larger size.

FIG. 1 additionally shows that the pullup handle 100 can include one or more vertical arms 108. The one or more vertical arms 108 attach to the rails 106 and form one "arm" of the U-shaped clamp 102. The benefit of having a pair of arms 108 is that the hollow space in the middle allows the arms 108 to be folded and the hollow space in the middle accommodates other portions of the pullup handle 100, allowing the folded to design to be more compact. In other words, a pair of arms 108 can be critical to ensure that the folded design is as compact as possible, making the pullup handles more transportable. The vertical arms 108 can be telescoping to allow the height of the U-shaped clamp 102 to be adjusted.

FIG. 1 moreover shows that the pullup handle 100 can include one or more hinges 110. The one or more hinges 110 are attached to each of the vertical arms 108. This allows the arms 108 to be folded, making the pullup handle 100 more compact and transportable. In particular, the hinges 110 allow the vertical arms 108 to lie flat parallel to the rails 106.

FIG. 1 also shows that the pullup handle 100 can include two cross-bars 112. The first cross-bar 112 is stationary and forces the two vertical arms 108 to move in concert with one another. I.e., it is attached permanently to the two vertical arms 108. The second cross-bar 112 can be fixed or can move relative to the vertical arms 108. This allows the second cross-bar 112 to adjust the height of the U-shaped clamp 102. The height of the second cross-bar 112 can be adjusted by inserting it into different slots along the vertical arms 108, by securing it with a screw, or using any other desired method. Adjusting the height of the second cross-bar 112 can allow the user to ensure that the pullup handle 100 hangs at the desired height, giving the proper spacing for the user's hands, as discussed below.

FIG. 1 further shows that the pullup handle 100 can include a brace 114. The brace 114 is attached to the rails 106 opposite the arms 108. The attachment between the brace 114 and the rails 106 is movable. That is, the brace 116 can move along the rails 106 to allow the user to adjust the inner spacing of the U-shaped clamp 102.

FIG. 1 additionally shows that the pullup handle 100 can include a support 116. The support 116 is attached to the brace 114. Thus, the support 116 forms the other "arm" of the U-shaped clamp 102. The support 116 is narrow enough that when the pullup handle is folded it fits between the arms 108. I.e., the support 116 fits in the gap between the arms 108 when folded. This is critical to allow the pullup handle 100 to be as compact as possible for transporting.

FIG. 1 moreover shows that the pullup handle 100 can include a second set of hinges 118. The second set of hinges 118 attach the support 116 to the brace 114. This allows the support 116 to be folded, making the pullup handle 100 more compact and transportable. In particular, the second set of hinges 118 allow the support 116 to lie flat parallel to the rails 106.

FIG. 1 also shows that the pullup handle 100 can include a second set of two cross-bars 120. The first cross-bar 120 is stationary and is attached permanently to the support 116. The second cross-bar 120 can be fixed or can move relative to the support 116. This allows the second cross-bar 120 to adjust the height of the U-shaped clamp 102. The height of the second cross-bar 120 can be adjusted by inserting it into different slots along the support 116, by securing it with a screw, or using any other desired method. Adjusting the height of the second cross-bar 120 can allow the user to ensure that the pullup handle 100 hangs at the desired height, giving the proper spacing for the user's hands, as discussed below.

FIG. 1 further shows that the pullup handle 100 can include a handle 122. The handle 122 supports the user during a pullup exercise. The handle 122 is attached to the rails 106. The handle may be made of any suitable material that is sufficient strong to support the user's weight. For example, the handle 122 can be made of metal, such as steel.

FIG. 1 additionally shows that the pullup handle 100 can include a grip 124 on the handle 122. The grip 124 prevents the user's hands from moving on the handle 122. For example, the grip 124 can be made of rubber or cloth attached to the handle 122, such that the rubber or cloth prevents the user's hands from moving along the handle 122. The grip 124 may be porous to prevent sweat from the user making the grip 124 slick or causing other problems.

FIG. 1 moreover shows that the pullup handle 100 can include a circular frame 126. The circular frame 126 allows the handle 122 to rotate relative to the rails 106 and the U-shaped clamp 102. That is, the U-shaped clamp 102 is secured on a surface and is immobile, but the handle 122 can still move within the circular frame 126.

The circular frame 126 includes one or more stops. The one or more stops allow the handle 122 to lock in certain positions relative to the circular frame 126. This means that the position of the handle 122 is fixed relative to the circular frame 126 during an exercise routine. That is, the stops allow the handle 122 to be placed in a desired position relative to the circular frame 126 and to remain in that position as long as desired by the user. There can be ball bearings or other mechanisms within the circular frame 126 which allows for easier rotation of the handle 122 relative to the circular frame 126.

Figure 2A:
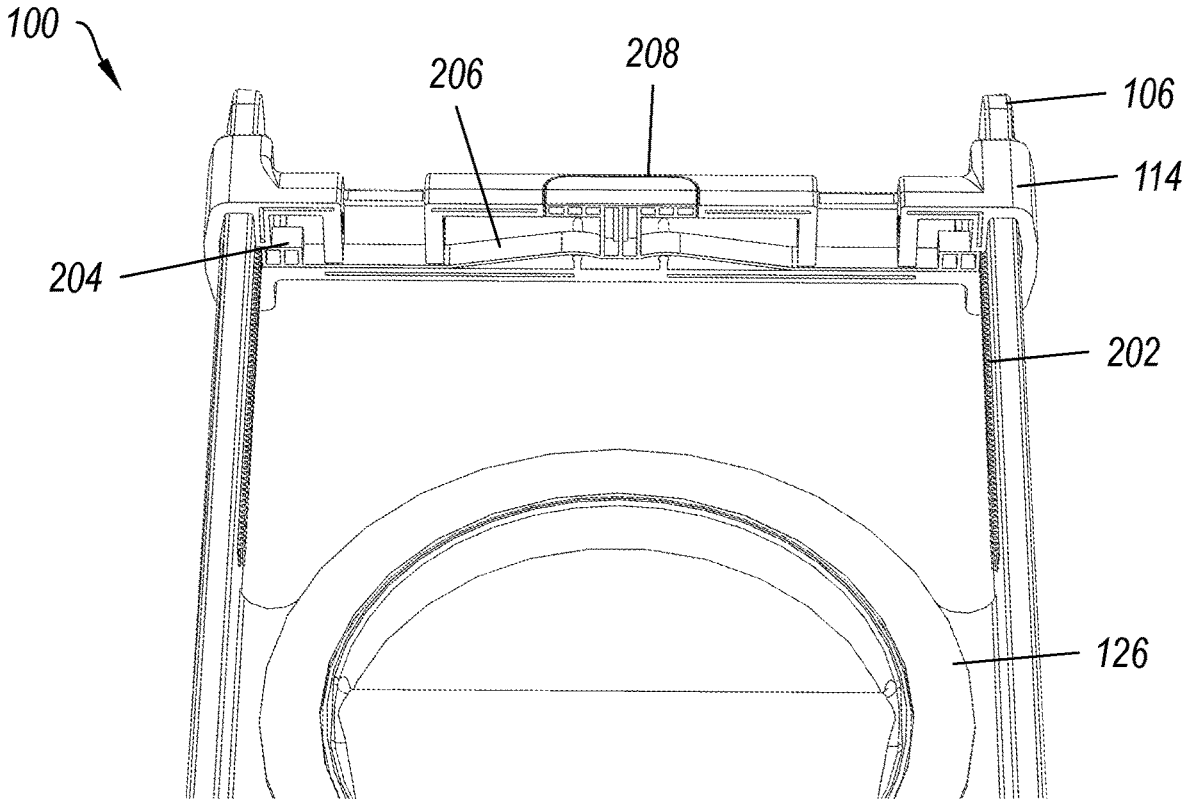
FIG. 2A illustrates close-up view of the button on the example of a doorway pullup handle.
Figure 2B:
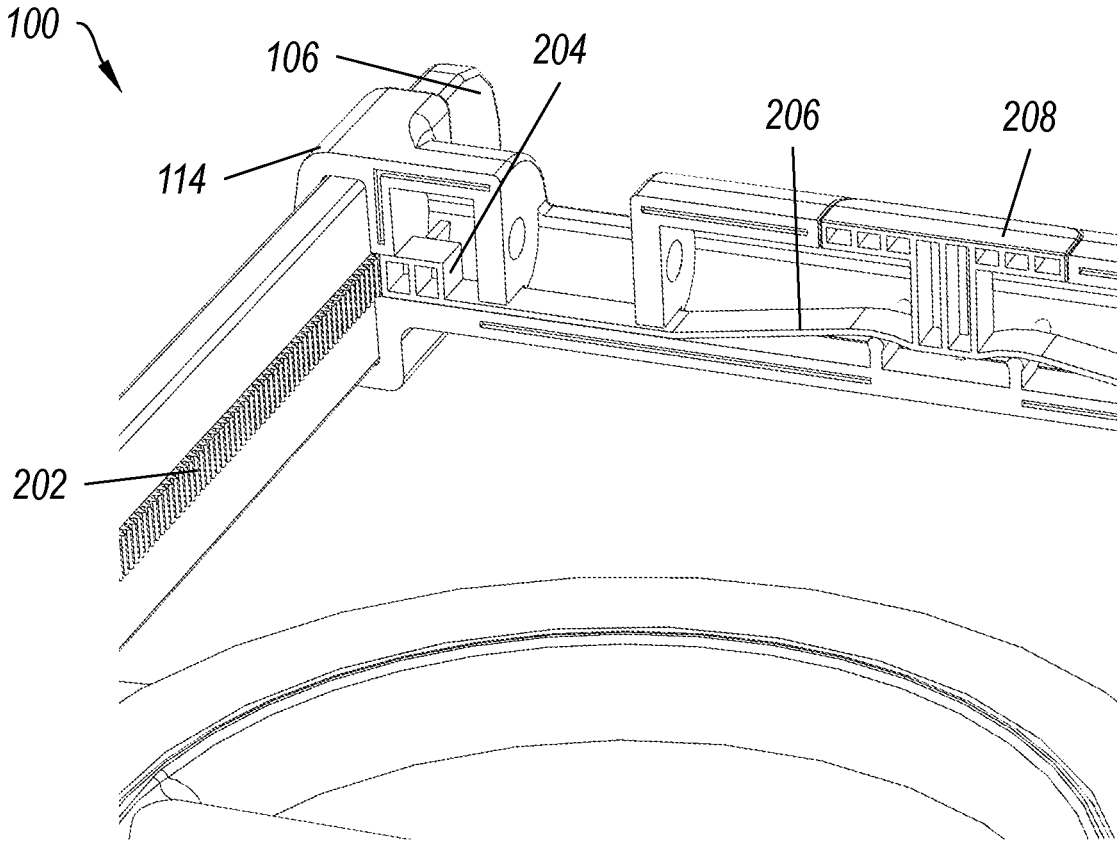
FIG. 2B illustrates an isometric close-up view of the button on the example of a doorway pullup handle.

FIGS. 2A-2B (collectively "FIG. 2") illustrate a cross-sectional view of the pullup handle 100. FIG. 2A illustrates close-up view of the button on the example of a doorway pullup handle 100; and FIG. 2B illustrates an isometric close-up view of the button on the example of a doorway pullup handle 100. The cross-sectional view shows how the U-shaped clamp can be locked into place when desired.

FIG. 2 shows that the pullup handle 100 can include one or more teeth 202 on the rails 106. The teeth 202 include protrusions which allow the brace 114 to be locked into place on the rail 106. In particular, the teeth 202 ensure that when a locking mechanism is engaged, the brace 114 does not move relative to the rail 106. A cross-section of the teeth 202 can look like a zigzag. This gives a high amount of friction preventing movement but allows a locking mechanism to be loosened, at which time the brace 114 moves easily relative to the rails 106.

FIG. 2 also shows that the pullup handle 100 can include a locking mechanism 204. The locking mechanism 204 engages the teeth 202 to lock the brace 114 in place relative to the rails 106. That is, the locking mechanism 204 pushes into the teeth 202 preventing movement of the brace.

FIG. 2 further shows that the pullup handle 100 can include a biasing mechanism 206. The biasing mechanism pushes the locking mechanism 204 onto the teeth 202. This is the normal or default state of the locking mechanism 204. I.e., the user must release the locking mechanism 204, as described below, in order to move the brace 114 relative to the rail 106. This is critical, because the locking mechanism 204 should be automatically engaged during an exercise routine.

FIG. 2 additionally shows that the pullup handle 100 can include a release button 208. The release button 208 allows a user to move the brace 114 relative to the rails 106. In particular, when depressed the release button 208 pushes on the central portion of the biasing mechanism 206 that forces the locking mechanism 204 away from the teeth 202, allowing the brace to move freely. Because the release button 208 pushes on the central portion of the biasing mechanism 206 it releases a locking mechanism on both sides of the brace 114. Therefore, a user pushes on the release button 208, moves the brace 114 into the desired position on the rails 106 and then releases the release button 208, locking the brace 114 into place along the rails 106.

Figure 3:
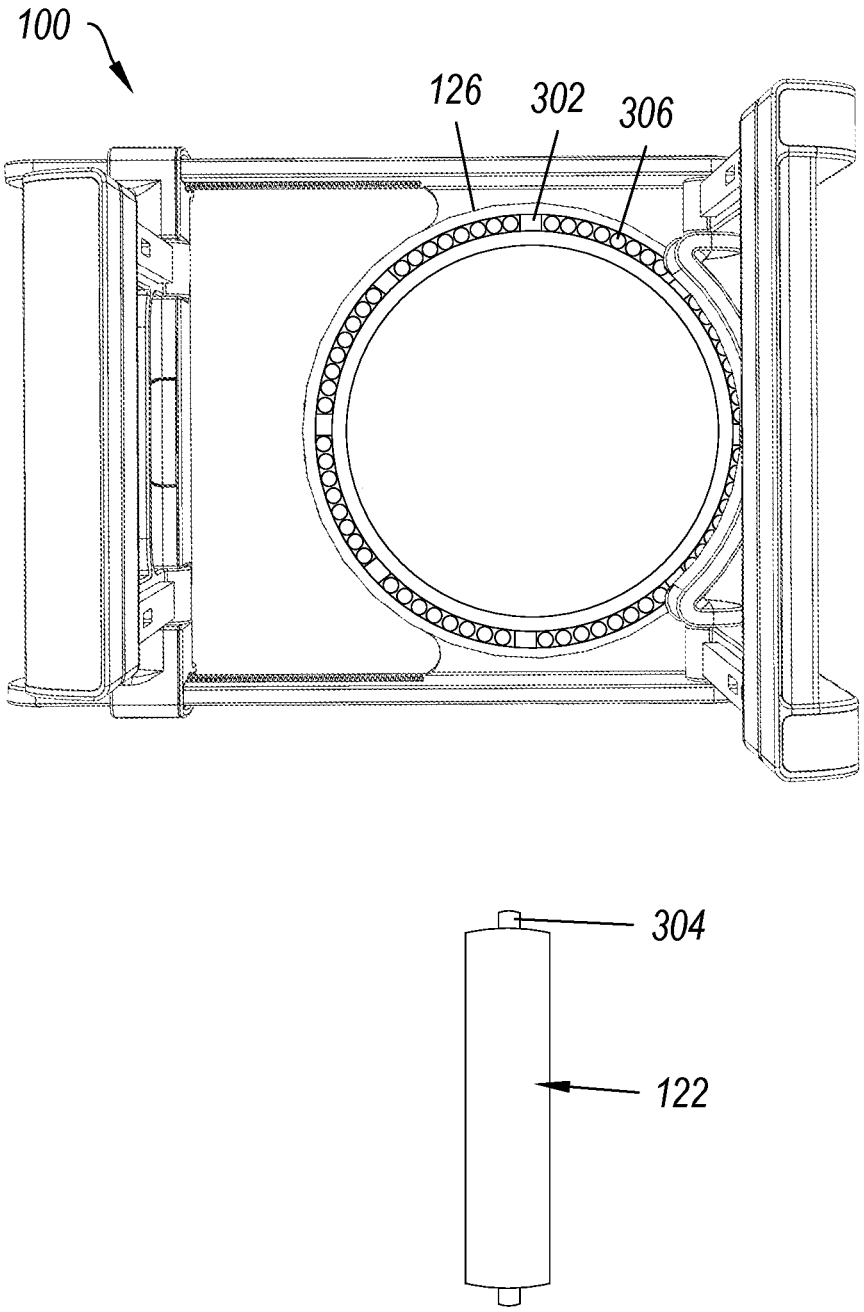
FIG. 3 illustrates a partially exploded view of FIG. 1G showing the relationship between the handle and the circular frame.

FIG. 3 illustrates a partially exploded view of FIG. 1G showing the relationship between the handle 122 and the circular frame 126. FIG. 3 shows that the circular frame 126 includes one or more stops 302. The one or more stops allow the handle 122 to lock in certain positions relative to the circular frame 126. This means that the position of the handle 122 is fixed relative to the circular frame 126 during an exercise routine. That is, the stops 302 and the protrusion 304 form a locking mechanism that allows the handle 122 to be placed in a desired position relative to the circular frame 126 and to remain in that position as long as desired by the user. There can be ball bearings 304 or other mechanisms within the circular frame 126 which allows for easier rotation of the handle 122 relative to the circular frame 126.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A pullup handle, the pullup handle comprising:

a U-shaped clamp, the U-shaped clamp configured to secure the pullup handle to a desired location, wherein the U-shaped clamp includes:

a pair of arms on a first side of the U-shaped clamp;

a support on a second side of the U-shaped clamp opposite the pair of arms;

a base between the pair of arms and the support, wherein the base includes a set of parallel rails;

a first set of hinges, wherein the first set of hinges attaches the pair of arms to the set of parallel rails; and a second set of hinges, wherein the second set of hinges attaches the support to the set of parallel rails;

wherein a width of the support is smaller than a gap between the pair of arms;

a handle attached on the base of the U-shaped clamp; and a grip, wherein the grip covers at least a portion of the handle.

2. The pullup handle of claim 1, wherein each arm in the pair of arms is telescoping.

3. The pullup handle of claim 1, wherein the first set of hinges includes a hinge on each arm in the pair of arms.

4. The pullup handle of claim 1, wherein the first set of hinges allows the pair of arms to move between perpendicular to the set of parallel rails and parallel to the set of parallel rails.

5. The pullup handle of claim 4, wherein the second set of hinges allows the support to move between perpendicular to the set of parallel rails and parallel to the set of parallel rails.

6. The pullup handle of claim 5, wherein the support and the pair of arms lie in a same plane when both are parallel to the set of parallel rails.

7. The pullup handle of claim 1, wherein the grip includes rubber.

8. The pullup handle of claim 1, wherein the grip includes cloth.

9. A pullup handle, the pullup handle comprising:

a U-shaped clamp, the U-shaped clamp configured to secure the pullup handle to a desired location, wherein the U-shaped clamp includes:

a pair of arms on a first side of the U-shaped clamp;

a support on a second side of the U-shaped clamp opposite the pair of arms, wherein the support includes a brace;

a base between the pair of arms and the support, wherein the base includes a set of parallel rails;

a first set of hinges, wherein the first set of hinges attaches the pair of arms to the set of parallel rails;

a second set of hinges, wherein the second set of hinges attaches the brace to the set of parallel rails;

a first cross-bar attached to the pair of arms opposite the first set of hinges;

a second cross-bar attached to the pair of arms;

a third cross-bar attached to the support opposite the second set of hinges; and a fourth cross-bar attached to the support;

wherein a width of the support is smaller than a gap between the pair of arms;

a handle attached on the base of the U-shaped clamp; and a grip, wherein the grip covers at least a portion of the handle.

10. The pullup handle of claim 9, wherein a position of the second cross-bar is adjustable relative to the pair of arms.

11. The pullup handle of claim 9, wherein a position of the fourth cross-bar is adjustable relative to the support.

12. The pullup handle of claim 9, wherein a position of the brace is adjustable relative to the set of parallel rails.

13. The pullup handle of claim 12, wherein each rail in the set of parallel rails includes one or more teeth.

14. The pullup handle of claim 13, wherein the brace includes:

a locking mechanism, wherein the locking mechanism engages the one or more teeth on each rail in the set of parallel rails;

a biasing mechanism, wherein the biasing mechanism keeps the locking mechanism engaged with the one or more teeth; and a release button, wherein the release button can release the locking mechanism from the one or more teeth.

15. The pullup handle of claim 9 further comprising a circular frame, wherein the circular frame:

is attached to the base; and allows rotation of the handle relative to the base.

16. The pullup handle of claim 15, wherein the circular frame includes a locking mechanism capable of locking a position of the handle relative to the circular frame.

17. The pullup handle of claim 16, wherein of the handle relative to the circular frame is a predetermined position relative to the circular frame, wherein the locking mechanism of the circular frame includes one or more stops, and wherein the one or more stops lock the handle in the predetermined position relative to the circular frame.

18. The pullup handle of claim 15, wherein the circular frame includes a set of ball bearings which allow the rotation of the handle relative to the circular frame.

* * * * *